United States Patent [19]

Franke

[11] Patent Number: 4,811,676

[45] Date of Patent: Mar. 14, 1989

[54] ASYMMETRIC MINIMUM RESISTANCE HULL

[76] Inventor: Peter Franke, 390 Jones Avenue, Toronto, Ontario, Canada, M4J 3G3

[21] Appl. No.: 125,927

[22] Filed: Nov. 27, 1987

[30] Foreign Application Priority Data

Mar. 27, 1987 [CA] Canada ..... 533145

[51] Int. Cl.[4] ..... B63B 1/10

[52] U.S. Cl. ..... 114/56; 114/61

[58] Field of Search ..... 114/39.1, 61, 123, 56, 114/57, 274

[56] References Cited

U.S. PATENT DOCUMENTS

| | | | |
|---|---|---|---|
| 2,464,957 | 3/1949 | Wood | 114/61 |
| 4,002,132 | 1/1977 | Nitzki | 114/61 |
| 4,008,674 | 2/1977 | Nitzki et al. | 114/61 |
| 4,348,977 | 9/1982 | Okajima | 114/61 |
| 4,389,958 | 6/1983 | March | 114/61 |
| 4,498,409 | 12/1985 | Edel | 114/61 |
| 4,714,041 | 12/1987 | Jaffre et al. | 114/61 |

*Primary Examiner*—Sherman D. Basinger
*Assistant Examiner*—Stephen P. Avila
*Attorney, Agent, or Firm*—John F. Smith; Thomas T. Rieder

[57] ABSTRACT

An elongate hull configuration includes a top decking, a forward cutting edge sloping downwardly, rearwardly and laterally from a top point, a first side wall sloping downwardly and inwardly throughout its length, and a second side wall having a spiraling configuration in which it slopes downwardly and outwardly adjacent the prow and slopes downwardly and inwardly adjacent the stern, the second side wall undergoing a smooth transition between its two ends.

8 Claims, 1 Drawing Sheet

ASYMMETRIC MINIMUM RESISTANCE HULL

This invention relates generally to the configuration or asymmerric boat or ship hulls such as those used on catamarans, as the outriggers of trimarans, or with other multi-hulled craft.

BACKGROUND OF THIS INVENTION

Asymmetric hulls are known in the prior art. They are used to reduce water pressure between the hulls or to provide lateral resistance. Lateral resistance is attained by means of foil-shaped hulls which generate a vacuum on the windward side of the hull. However, the generation of a vacuum, whether on one side of an asymmetric hull or on both sides of a mono hull, is undesirable.

Bulbous noses are also known in the prior art. They reduce the amount of water that has to be accelerated by the bow, by allowing water which is in the path of the moving hull to escape in the direction of least resistance. The bow used in the present invention saves energy in a similar way, but it does not protrude forward like a nose. The bow is an integral part of the hull.

GENERAL DESCRIPTION OF THIS INVENTION

In view of the foregoing discussion, it is the object of an aspect of this invention to provide an improved hull configuration for multi-hull craft.

Accordingly, this invention provides, for use in a plural hull vessel, a hull configuration having a prow and a stern, comprising:

a forward cutting edge at the prow sloping downwardly, rearwardly and laterally from a top point, a first side wall maintaining throughout its length a downward and inward slope and terminating at said edge, and a second side wall terminating at said edge, said second side wall having a spiraling configuration in which it slopes downwardly and outwardly adjacent the said edge and slopes downwardly and inwardly adjacent the stern, the second side wall undergoing a smooth transition between its two ends.

Further, this invention provides a catamaran having two spaced-apart and parallel hulls, and means for propelling the catamaran, each hull having a hull configuration having a prow and a stern, comprising:

a forward cutting edge at the prow sloping downwardly, rearwardly and laterally from a top point, a first side wall maintaining throughout its length a downward and inward slope and terminating at said edge, and a second side wall terminating at said edge, said second side wall having a spiraling configuration in which it slopes downwardly and outwardly adjacent the said edge and slopes downwardly and inwardly adjacent the stern, the second side wall undergoing a smooth transition between its two ends, the two hulls being arranged such that their cutting edges slope downwardly and inwardly toward each other.

Finally, this invention provides a catamaran having two spaced-apart and parallel hulls, and means for propelling the catamaran, each hull having a hull configuration having a prow and a stern, comprising:

a forward cutting edge at the prow sloping downwardly, rearwardly and laterally from a top point, a first side wall maintaining throughout its length a downward and inward slope and terminating at said edge, and a second side wall terminating at said edge, said second side wall having a spiraling configuration in which it slopes downwardly and outwardly adjacent the said edge and slopes downwardly and inwardly adjacent the stern, the second side wall undergoing a smooth transition between its two ends, the two hulls being arranged such that their cutting edges slope downwardly and outwardly away from each other.

GENERAL DESCRIPTION OF THE DRAWINGS

Two embodiments of this invention are illustrated in the accompanying drawings, in which like numerals denote like parts throughout the several views, and in which.

Figure 1:
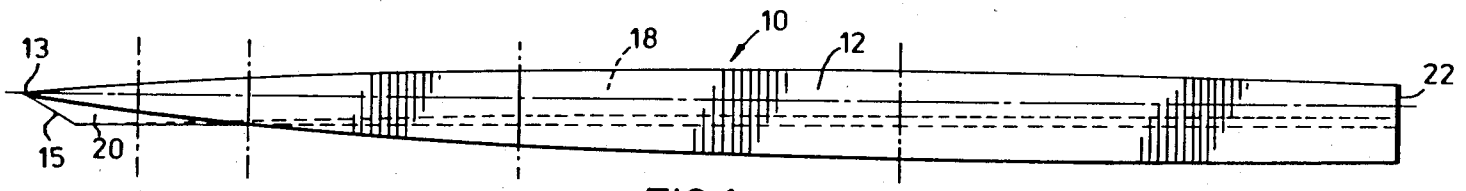
FIG. 1 is a plan view of a hull configuration constructed in accordance with this invention.
Figure 2:
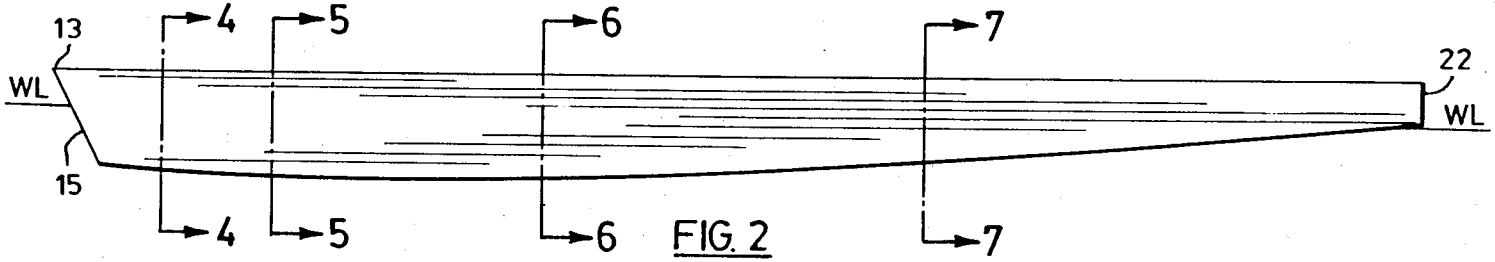
FIG. 2 is a side elevation of the hull configuration shown in FIG. 1.
Figures 3, 4, 5, 6, 7, 8:
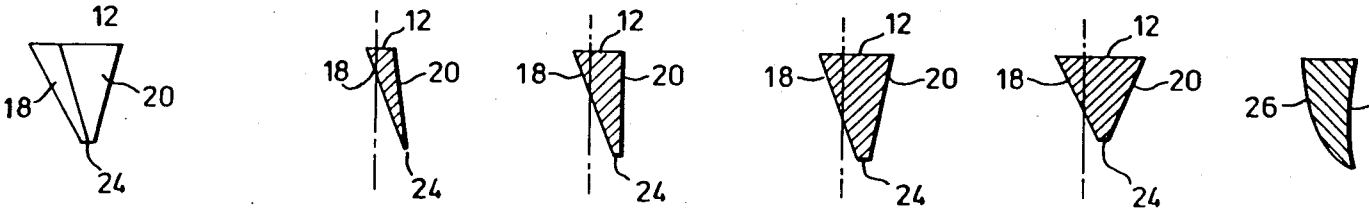
FIG. 3 is a front elevational view thereof.

FIGS. 4 through 7 are sectional views taken at the lines 4—4, 5—5, 6—6 and 7—7, respectively, in FIG. 2; and FIG. 8 illustrates an alternative embodiment, and corresponds to the section of FIG. 5.

DETAILED DESCRIPTION OF THE DRAWINGS

With reference to the drawings, a hull 10 can be seen, having a hull configuration which in the illustrated embodiment includes an elongated top deck 12 which converges forwardly to a substantial point 13. The hull 10 has a forward cutting edge 15 which slopes downwardly, rearwardly and laterally from the top point 13. Although the hull 10 is shown as an individual unit having its own top deck 12, it will be understood from what follows that the hull could be incorporated with a larger top deck stretching between two hulls, as is common in some catamaran constructions.

A first side wall 18 (see FIG. 3) extends rearwardly from the cutting edge 15 and maintains throughout its length a downward and inward slope, as with conventional hulls.

The hull 10 further incorporates a second side wall 20 having a spiraling configuration in which it slopes downwardly and outwardly adjacent the cutting edge 15 at the prow, and slopes downwardly and inwardly adjacent the stern 22. The second side wall 20 undergoes a smooth transition between its two ends.

In the embodiment shown, the side walls 18 and 20 come together at the bottom of the hull configuration to form a keel 24 which slopes rearwardly and upwardly over the rear portion of the hull configuration, i.e. from a location ahead of section 6—6 to the stern 22. In the variation shown in FIG. 8, the side wall 26 which corresponds with side wall 18 in FIG. 4 has, over a major portion of its extent, an outwardly convex shape when seen in vertical lateral section. The inside side wall 28 has a concave shape when seen in vertical lateral section. It will be understood that one or both of the side walls may be curved in this way.

Test trials have shown that a catamaran consisting of two hulls as described, arranged such that the cutting edges of the prow slope downwardly and inwardly toward each other, out-performs conventional catamarans of the same size.

The side walls of the hull configuration may be constructed of a sheet material chosen from the group: plywood, plastic, metal.

As suggested previously, the hull described herein may be used either as an independent hull by itself or as the bottom configuration of a larger structure such as a wide-deck catamaran. In view of this, the present invention may be thought of as a buoyant keel or lower hull, which is not limited by the particular construction of the upper deck.

While two embodiments of this invention have been illustrated in the accompanying drawings and described hereinabove, it will be evident to those skilled in the art that changes and modifications may be made therein without departing from the essence of this invention, as set forth in the appended claims.

The embodiments of the invention in which an exclusive property or privilege is claimed are defined as follows:

1. For use in a plural hull vessel, a hull configuration having a prow and a stern, comprising:

a forward cutting edge at the prow sloping downwardly, rearwardly and laterally from a top point, a first side wall sloping downwardly and inwardly throughout its length, and terminating at said edge, and a second side wall terminating at said edge, said second side wall having a spiraling configuration in which it slopes downwardly and outwardly adjacent the prow and slopes downwardly and inwardly adjacent the stern, the second side wall undergoing a smooth transition between its two ends.

2. The invention claimed in claim 1, in which the side walls come together at the bottom of the hull configuration to form a keel which slopes rearwardly and upwardly over the rear portion of the hull configuration.

3. The invention claimed in claim 1, in which the side walls are constructed of sheet material.

4. The invention claimed in claim 3, in which the sheet material is chosen from the group: plywood, plastic, metal.

5. The invention claimed in claim 1, in which at least one side wall has, over a major portion of its extent, an outwardly convex shape when seen in vertical lateral section.

6. The invention claimed in claim 1, in which the first and second side walls have, over a major portion of their extent, an outwardly convex shape and an outwardly concave shape, respectively, when seen in vertical lateral section.

7. A catamaran having two spaced-apart and parallel hulls, and means for propelling the catamaran, each hull having a hull configuration having a prow and a stern, comprising:

a forward cutting edge at the prow sloping downwardly, rearwardly and laterally from a top point, a first side wall sloping downwardly and inwardly throughout its length and terminating at said edge, and a second side wall terminating at said edge, said second side wall having a spiraling configuration in which it slopes downwardly and outwardly adjacent the said edge and slopes downwardly and inwardly adjacent the stern, the second side wall undergoing a smooth transition between its two ends, the two hulls being arranged such that their cutting edges slope downwardly and inwardly toward each other.

8. A catamaran having two spaced-apart and parallel hulls, and means for propelling the catamaran, each hull having a hull configuration with a prow and a stern, comprising:

a forward cutting edge at the prow sloping downwardly, rearwardly and laterally from a top point, a first side wall maintaining throughout its length a downward and inward slope and terminating at said edge, and a second side wall terminating at said edge, said second side wall having a spiraling configuration in which it slopes downwardly and outwardly adjacent the said edge and slopes downwardly and inwardly adjacent the stern, the second side wall undergoing a smooth transition between its two ends, the two hulls being arranged such that their cutting edges slope downwardly and outwardly away from each other.

* * * * *